United States Patent [19]

Lloyd

[11] Patent Number: 4,681,462

[45] Date of Patent: Jul. 21, 1987

[54] RECORDING DEVICES

[76] Inventor: Benjamin Lloyd, 24 Woodbank Drive, Bury, Lancashire, BL8 1DR, Great Britain

[21] Appl. No.: 748,158

[22] Filed: Jun. 24, 1985

[30] Foreign Application Priority Data

Jun. 28, 1984 [GB] United Kingdom ..... 8416511

[51] Int. Cl.[4] ..... G04C 17/00; A44C 5/00

[52] U.S. Cl. ..... 368/69; 368/110; 368/281; 24/265 WS; 224/164; 224/903

[58] Field of Search ..... 368/101, 107, 110, 113, 368/282, 281, 69–70, 108, 109, 111, 112, 276; 224/164, 175, 903; 24/265 WS

[56] References Cited

U.S. PATENT DOCUMENTS

| | | | |
|---|---|---|---|
| 601,982 | 4/1898 | Deirson | 224/903 |
| 2,926,825 | 3/1960 | Wing | 224/903 |
| 3,763,646 | 10/1973 | Jeanmonod | 368/282 |
| 4,396,296 | 8/1983 | Stodden | 368/101 |

FOREIGN PATENT DOCUMENTS

| | | | |
|---|---|---|---|
| 3036056 | 4/1981 | Fed. Rep. of Germany | 368/113 |
| 471413 | 5/1969 | Switzerland | 368/282 |
| 648177 | 3/1985 | Switzerland | 368/282 |

*Primary Examiner*—Vit W. Miska

*Attorney, Agent, or Firm*—Ross, Ross & Flavin

[57] ABSTRACT

The recording device is embodied as a stop watch 10 comprising a watch body 11 having a two-piece strap to secure the stop watch 10 to one hand 20 of its user. On one side, the watch body 11 has a display face 13 and an elongate button 16 for controlling the functioning of the watch 10 and the display on the display face 13. A central region 26 of the watch body 11 is flexible enabling the watch body 11 to be bent in a U or J shape around the hand 20 between forefinger 28 and thumb 27, the two pieces 21, 22 of the strap holding the watch body 11 securely on the hand 20 and wrist 24. With the watch body 11 in the latter described disposition on the hand 20, the button 16 can be actuated by the finger tips 31. Thus, the stop watch 10 can be easily operated one-handed making it particularly suitable for use by athletes.

4 Claims, 3 Drawing Figures

RECORDING DEVICES

FIELD OF THE INVENTION

This invention concerns recording devices.

BACKGROUND ART

The term "recording devices" in the context of the present invention is to be taken to mean either a device which can be used as a counter, that is to say an instrument for recording the number of repetitions of an operation or of a thing produced, or as a watch, that is to say as an ordinary watch, as a watch with other functions as well as a time function, or as a stop watch.

It is a recording device for the latter use (i.e. as a stop watch) with which the present invention is primarily concerned.

In particular, the present invention concerns a recording device with a stop watch function for use by athletes, such as runners, who participate in what are commonly termed track events, that is to say an event which involves running around a marked track over certain specified distances. It can also be used by any sportsmen wishing to improve their speed and stamina.

It is, in most cases, important for such athletes that the duration of their training and competitive runs are timed accurately. This enables them to compare their performance with other such athletes and/or to check their progress and improved fitness in relation to previous performances. The most accurate way to time any performance is by means of a stop watch which times in hours, minutes and seconds and even fractions of seconds. Normally, the actuation of the stop watch is carried out by a companion of the runner. However, it may not always be possible for the athlete to engage the services of another person. The athlete must therefore operate the stop watch himself.

Self operation of a conventional hand held stop watch by the athlete entails several disadvantages.

Firstly, the athlete has to use some of his/her concentration on holding the watch and operating the correct button at the start and the finish of a run. Secondly, a sprinter cannot hold and operate a stop watch while supporting himself/herself with his/her hands in a crouch start. Thirdly, the stop watch has to be carried in one hand and this interfers with the relaxed arm action of the athlete during running. To try and avoid this latter drawback one can employ a wrist watch with special stop watch facilities. However, this latter solution is no better as the athlete has to use the other hand to operate the stop watch facilities of the wrist watch. Athletes such as sprinters to whom it is all important to get off to a fast start in a race/run find it nearly impossible to bring both hands together at the start of a run to operate the watch. Other athletes involved in running also find it very awkward to bring the hands together. At the finish of a run it is conceivable that the athlete may press the wrong button on the watch because his/her concentration is on the run. Furthermore, at high speed, operation of such watches as aforesaid can be dangerous as sudden curtailment of proper arm action can cause twisting of the trunk without consequent damage to the spine.

OBJECT OF INVENTION

It is an object of the present invention to provide a recording device, with a stop watch function, that can be worn on one hand of the user, e.g. an athlete, and which can also be operated one-handed by the user with accuracy and without difficulty.

SUMMARY OF THE INVENTION

With this object in view, the present invention provides a recording device comprising recording means and, attached thereto, securing means for securing the device to one hand of a user thereof, said recording means having a display face portion, which is capable of displaying any recorded information, and an actuator portion for actuation of the recording means and for controlling the display on the display face portion, said recording means and/or said securing means so being adapted that when the device is secured to the hand of the user the actuator portion is positioned on the palm side of the hand enabling it to be actuated by one or more digits of the same said hand.

Advantageously, the recording device is a digitally operated stop watch comprising the recording means in the form of a watch body and the securing means in the form of a two-piece strap.

Preferably, the display face portion and the actuator portion are disposed on the same side of the watch body. The display face portion may have a display face set into the surface thereof and the actuator portion may have an elongate button protruding from the surface thereof and provided for controlling the timing operation of the stop watch and for controlling the display on the display face.

The strap, which is two-piece, may have one piece attached directly to the watch body, said one piece being of elastic material and being a continuous band, the watch body being secured to one side thereof. The second piece of the strap may also be a band of elastic material and may have a buckle to facilitate its securement to the user's wrist. Advantageously said one piece of the strap is connected to said second piece of the strap by means of a stud.

The watch body i.e. the recording means, is adapted as aforesaid by advantageously being flexible in a central region, between the display face portion and the actuator portion, so that it can be bent into a substantially U or J shape on the hand.

BRIEF DESCRIPTION OF THE DRAWINGS

The invention will be described further, by way of example, with reference to the accompanying drawing in which.

DESCRIPTION OF THE ILLUSTRATED EMBODIMENT

The illustrated preferred recording device is a digitally operated stop watch 10 comprising recording means, in the form of a watch body 11, and securing means attached to the watch body 11 for securing the stop watch 10 to one hand 20 of a user thereof and being in the form of a two-piece strap.

Figure 1:
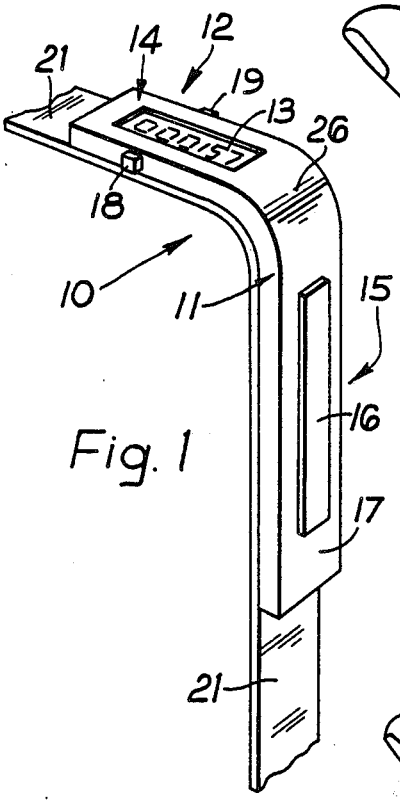
FIG. 1 is a perspective view of part of a preferred embodiment of the recording device of the invention.

The watch body 11 is substantially elongate and flat, making it substantially rectangular in cross-section, and has a thickness of approximately 1 cm. As illustrated more clearly in FIG. 1, the watch body 11 has a display face portion 12, having a display face 13 set into surface 14 of the display face portion 12, and an actuator portion 15 for controlling the functioning of the stop watch 10 and hence the display on the display face 13 of the display face portion 12 of the watch body 11.

The display of the display face 13 is a standard L.C.D. (liquid crystal display), which can show elapse time in e.g. hours, minutes seconds and fractions of seconds and any other information which may be desired, within technically feasible limits.

The actuator portion 15 has an elongate button 16 extending over more than one half the length of the actuator portion 15 protruding from surface 17 of the actuator portion 15. However, if desired the button 16 can be flush with surface 17 of the actuator portion 15. The button 16 is used to control the time recording operation of the stop watch 10 and therefore to control the display on the display face 13. The watch body 11 is also provided on its display face portion 12 with display face reset button 18 on the one side thereof adjacent the display face 13 (although this function could be fulfilled by the stop/start button 16 if desired) and with a backlight button 19 for operating a light source (not shown) for the display face 13.

The display face 13 and button 16 (on the actuator 15) are disposed on the same side of the watch body 11 for a reason which will clearly emerge hereinafter.

As previously mentioned, attached to the watch body 11 is the hand securing means for the watch 10, said means being a two-piece strap. One piece 21 of the strap is attached directly to the watch body and is of elastic material. It is a continuous band, the watch body 11 being secured e.g. by an adhesive, to one side thereof. Said one piece 21 of the strap is connected to the second piece 22 of the strap by means of a stud 23, the second piece 22 of the strap being intended for securement around the user's wrist 24. To facilitate its securement to the wrist 24, the second piece 22 is provided with a buckle 25.

The watch body 11 is adapted to facilitate its snug and unobtrusive engagement on one hand 20 of the user of the stop watch 10 by being flexible in central region 26, between the display face portion 12 and the actuator portion 15, so that it can be bent into a substantially U or J shape on the hand 20.

Figure 2:
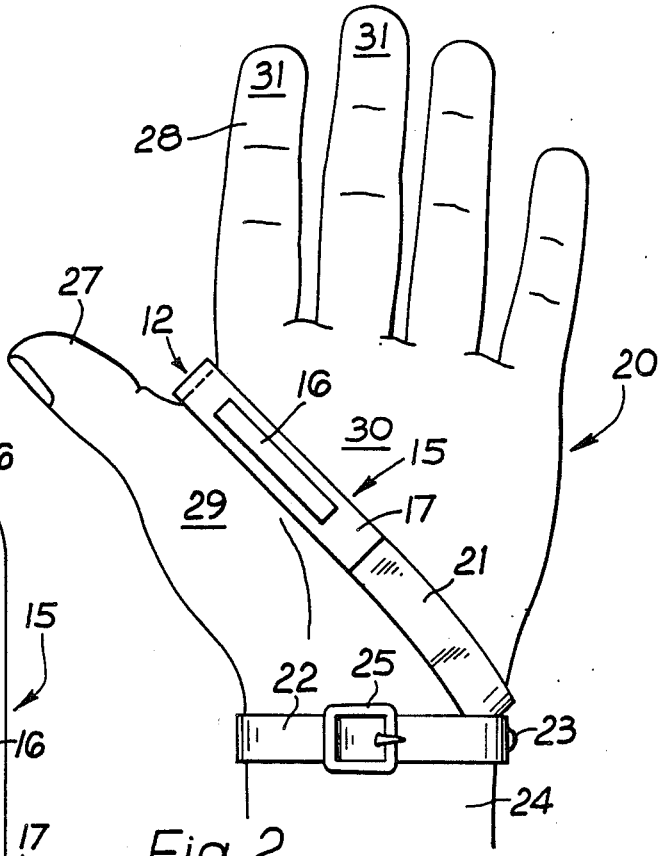
FIG. 2 illustrates the preferred embodiment of the recording device of FIG. 1 in the manner in which it is secured to one hand of a user thereof, said hand being open.

As illustrated in FIG. 2, in fitting the stop watch 10 onto the hand 20, the watch body 11 is positioned between thumb 27 and forefinger 28, with the actuator portion 15 of the watch body 11 having the elongate button 16 resting just below the fleshy part 29 of the palm 30 of the hand 20 (elongate button 16 side facing away from the palm 30) and with the display face portion 12 having the display face 13 being on the back (not shown) of the hand 20. Said one piece 21 of the strap extends as far as that part of the wrist 24 which is remote from the thumb 27 where it is joined by the stud 23 to the second piece 22 of the strap which is intended to go around the user's wrist 24.

Figure 3:
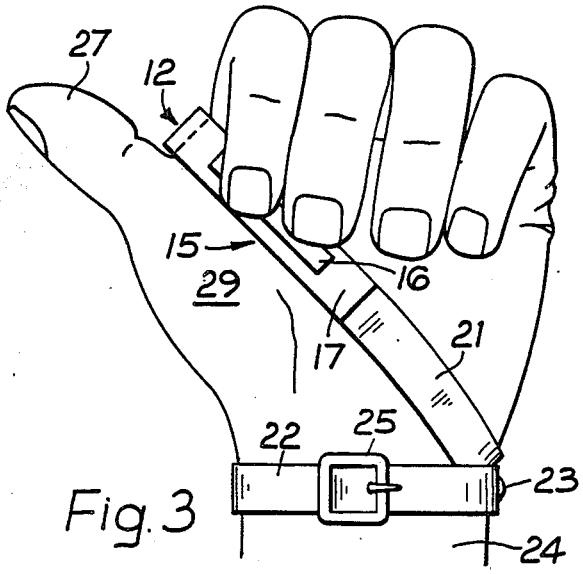
FIG. 3 is a view similar to that of FIG. 1, but with the hand being closed and some of the fingers thereof actuating the preferred device.

Referring now to FIG. 3, it will clearly be seen therefrom that the position of the actuator portion 15, having the elongate button 16, in relation to the palm 30, and the size and shape of the button 16, means that said button 16 can quite easily be touched by the finger tips 31 of the hand 20 to which the stop watch 10 is strapped. This is ideal for athletes, such as runners, because it means that the stop watch 10 can be activated simply by the athlete pressing the button 16 with one or more fingers, either from a standing start or when moving at high speed, without any impediment of the athlete's performance or his/her endangerment. Before the start of the run, the athlete need simply press the reset button 18 and, if necessary, the backlight button 19.

It will be perceived from the foregoing that the stop watch 10 of the present invention is quite a considerable improvement on known stop watches.

The invention is not confined to the precise details of the foregoing and variations may be made thereto within the scope of the invention. Thus, for example, the watch body can be permanently substantially of a U or J shape, so that it fits between the thumb and the forefinger, without the need for the watch body to be very flexible. Alternatively, the strap could be in one piece and long enough and elastic enough to be twisted around the hand and wrist of the user. Yet a further alternative would be to have a strap which is detachable from the watch body, in a similar fashion to the strap of a wrist watch.

I claim:

1. In combination with a recording device having a display for displaying information: securing means for securing the recording device to either hand of a user, and an actuator for actuating the recording device and controlling the display, the securing means being so adapted that the actuator is positionable on the palm side of the user's hand enabling it to be actuated by one or more digits of the same hand, and the display is positionable on the backside of the hand, the recording device being adapted to fit between the forefinger and thumb of the user's hand by being flexible in a central region between the display and actuator.

2. In combination with a recording device comprising:

a display for displaying information, an actuator for actuating the recording device and controlling the display, securing means for securing the recording device to either hand of a user, the display and the actuator being disposed on one side of the device at or adjacent to respective opposite ends of said one side so as to define a central region between the display and the actuator, the actuator being positionable on the palm side of the user's hand so as to face away therefrom and enabling it to be actuated by one or more digits of the same hand, the display being positionable on the backside of the hand so as to face away therefrom, the central region being positionable between the forefingers and thumb of the hand.

3. The device as claimed in claim 2 wherein the central region is flexible.

4. The device as claimed in claim 2 being permanently substantially of a U or J shape.

* * * * *